US009182083B2

(12) United States Patent
Chiu et al.

(10) Patent No.: US 9,182,083 B2
(45) Date of Patent: Nov. 10, 2015

(54) LIGHT EMITTING DIODE BULB

(71) Applicant: Beautiful Light Technology Corp., Chiayi (TW)

(72) Inventors: Shih-Ting Chiu, Chiayi (TW); Chien-Wen Chiu, Chiayi (TW); Yu-Te Lin, Chiayi County (TW)

(73) Assignee: BEAUTIFUL LIGHT TECHNOLOGY CORP., Chiayi (TW)

( * ) Notice: Subject to any disclaimer, the term of this patent is extended or adjusted under 35 U.S.C. 154(b) by 77 days.

(21) Appl. No.: 14/205,351

(22) Filed: Mar. 11, 2014

(65) Prior Publication Data

US 2014/0376230 A1 Dec. 25, 2014

(30) Foreign Application Priority Data

Jun. 24, 2013 (TW) ..... 102122398 A

(51) Int. Cl.

| | |
|---|---|
| ***F21K 99/00*** | (2010.01) |
| ***F21V 29/85*** | (2015.01) |
| *F21V 3/02* | (2006.01) |
| *F21V 3/04* | (2006.01) |
| *F21V 23/00* | (2015.01) |
| *F21Y 101/02* | (2006.01) |
| *F21Y 111/00* | (2006.01) |
| *F21V 29/70* | (2015.01) |
| *F21V 29/87* | (2015.01) |
| *F21V 29/89* | (2015.01) |

(52) U.S. Cl.

CPC ..... *F21K 9/135* (2013.01); *F21K 9/1355* (2013.01); *F21V 29/85* (2015.01); *F21V 3/02* (2013.01); *F21V 3/0436* (2013.01); *F21V 23/006* (2013.01); *F21V 29/70* (2015.01); *F21V 29/87* (2015.01); *F21V 29/89* (2015.01); *F21Y 2101/02* (2013.01); *F21Y 2111/007* (2013.01)

(58) Field of Classification Search

CPC ..... F21V 29/004; F21V 29/85; F21V 29/87; F21V 29/70; F21V 29/503; F21V 29/26; F21V 29/262; F21V 29/71; F21V 29/713; F21V 23/009; F21V 3/02; F21V 23/006; F21V 3/0436; F21K 9/135; F21K 9/1355; F21Y 2111/007; F21Y 2101/02

See application file for complete search history.

(56) References Cited

U.S. PATENT DOCUMENTS 7,758,223 B2 * 7/2010 Osawa et al. ..... 362/547
7,847,471 B2 * 12/2010 Liu et al. ..... 313/46

(Continued)

FOREIGN PATENT DOCUMENTS

CN 201555049 U 8/2010
CN 201636574 U 11/2010

(Continued)

*Primary Examiner* — Bao Q Truong
(74) *Attorney, Agent, or Firm* — CKC & Partners Co., Ltd.

(57) ABSTRACT

A light emitting diode bulb includes a lampshade, a lamp housing, a heat sink, a driving circuit, light emitting diode modules and a lamp cap. The lamp housing is connected to the lampshade and includes a cup-shaped casing and a heat conduction part. The heat conduction part is disposed in the cup-shaped casing. The heat sink is disposed in the lampshade and includes a heat-dissipating shell and a heat-dissipating frustum. The heat-dissipating shell covers the heat conduction part. The heat-dissipating frustum includes a top surface, a bottom surface and four side surfaces. The heat-dissipating frustum includes an axis vertical to the bottom surface. An included angle between the axis and each of the side surfaces is smaller than 90 degrees. The light emitting diode modules are adhered to the top surface and the side surfaces and connected to the driving circuit. The lamp cap is connected to the driving circuit.

10 Claims, 3 Drawing Sheets

(56) References Cited

U.S. PATENT DOCUMENTS

| | | | | |
|---|---|---|---|---|
| 2009/0175041 | A1 | 7/2009 | Yuen et al. | |
| 2010/0264799 | A1* | 10/2010 | Liu et al. | 313/46 |
| 2010/0277067 | A1 | 11/2010 | Maxik et al. | |
| 2014/0153236 | A1* | 6/2014 | CHEN et al. | 362/235 |

FOREIGN PATENT DOCUMENTS

| | | | |
|---|---|---|---|
| CN | 201803158 | U | 4/2011 |
| CN | 102315207 | A | 1/2012 |
| CN | 102472464 | A | 5/2012 |
| CN | 103123104 | A | 5/2013 |
| EP | 2357402 | A2 | 8/2011 |
| JP | 3171093 | U | 9/2011 |
| JP | 3179420 | U | 10/2012 |
| TW | 201118308 | A | 6/2011 |
| TW | M437919 | U | 9/2012 |
| TW | M453077 | U | 5/2013 |
| WO | 2011105030 | A1 | 9/2011 |
| WO | 2011155432 | A1 | 12/2011 |
| WO | 2013014821 | A1 | 1/2013 |

* cited by examiner

LIGHT EMITTING DIODE BULB

RELATED APPLICATIONS

This application claims priority to Taiwan Application Serial Number 102122398, filed Jun. 24, 2013, which is herein incorporated by reference.

BACKGROUND

1. Field of the Invention

The present invention relates to a bulb, and more particularly to a light emitting diode bulb.

2. Description of Related Art

Light emitting diodes (LEDs) have advantages of small size, low driving voltage, long service life and environmental protection. Therefore, light emitting diode bulbs have gradually replaced conventional tungsten bulbs and have been used widely. In order to remove heat generated from the light emitting diode bulb in operation, a common way is to dispose a radiator in the light emitting diode bulb. The heat dissipates to the external atmosphere through contacting a surface of the radiator with the external atmosphere. Furthermore, in order to improve the heat-dissipating function, many radiators are set with heat dissipating fins to increase the area of the surface of the radiators contacting with the external atmosphere.

However, it is difficult to manufacture and assemble such radiators. addition, the radiators can achieve the object of dissipating heat, but they typically don't have an electric and heat insulation function, so that users often get an electric shock or are scalded while taking the radiators. Moreover, the size of the radiator is big, which not only increases the overall volume of the bulb, but also affects the appearance of the bulb. Additionally, although the light emitting diode bulb basically has an illumination function, the light output of which is small and thus has limited applicability.

Hence, a light emitting diode bulb with larger light output range and a superior heat-dissipating function is needed to overcome the foregoing problems.

SUMMARY

One aspect of the present invention is to provide a light emitting diode bulb, which can increase light-emitting range and have functions of high heat dissipation and electric insulation.

Another aspect of the present invention is to provide a light emitting diode bulb, which can simplify molding and assembling processes, thereby decreasing manufacture cost and achieving aesthetic and useful effects.

According to the aforementioned aspects, the present invention provides a light emitting diode bulb. The light emitting diode bulb includes a lampshade, a lamp housing, a heat sink, a driving circuit, a plurality of light emitting diode modules and a lamp cap. The lamp housing is connected to the lampshade, in which the lamp housing includes a cup-shaped casing and a heat conduction part. The heat conduction part is disposed in the cup-shaped casing, in which the heat conduction part is a hollow cylinder and has an accommodation space. The heat sink is disposed in the lampshade, in which the heat sink includes a heat-dissipating shell and a heat-dissipating frustum, The heat-dissipating shell covers an outer surface of the heat conduction part. The heat-dissipating frustum is connected to the heat-dissipating shell. The heat-dissipating frustum includes a top surface, a bottom surface and four side surfaces, in which the top surface and the bottom surface are rectangular, and an area of the top surface is greater than an area of the bottom surface, and the side surfaces are inverse trapezoids. The heat-dissipating frustum includes an axis vertical to the bottom surface, and an included angle between the axis and each of the side surfaces is smaller than 90 degrees. The driving circuit is disposed in the accommodation space. The light emitting diode modules are adhered to the top surface and the side surfaces of the heat-dissipating frustum, in which the light emitting diode modules are electrically connected to the driving circuit. The lamp cap is secured to a bottom of the cup-shaped casing and electrically connected to the driving circuit.

According to an embodiment of the present invention, the included angle between the axis and each of the side surfaces is from 0 to 45 degrees.

According to another embodiment of the present invention, the light emitting diode bulb further includes conductive glue filling the accommodation space.

According to still another embodiment of the present invention, each of the light emitting diode modules is a common-anode diode module or a common-cathode diode module.

According to further another embodiment of the present invention, the heat-dissipating frustum is fixed on the heat-dissipating shell by a screwing means or a soldering means.

According to yet another embodiment of the present invention, the heat-dissipating shell and the heat-dissipating frustum are embedded with each other to form a one-body structure.

According to still further another embodiment of the present invention, the heat sink is made of a metal.

According to yet further another embodiment of the present invention, the lamp housing is made of heat conducting plastics.

According to yet further another embodiment of the present invention, a bottom of the lampshade has a flange, and the cup-shaped casing has an emarginate fringe corresponding to the flange, in which the flange and the emarginate fringe are interlocked together.

According to yet further another embodiment of the present invention, a bottom of the heat-dissipating shell has an annular recess, and when the flange and the emarginate fringe are interlocked together. the annular recess is against and secures the flange.

According to the aforementioned embodiments of the present invention, it is known that an effect of omni-directional lighting can be achieved by disposing the light emitting diode modules on the trapezoid heat-dissipating frustum. Moreover, by connecting the heat conducting plastics and the heat sink, heat generated from the light emitting diode modules is directly conducted from the heat sink to the lamp housing and further conducted outward, so that a heat-dissipating effect is achieved. In addition, the lamp housing has a heat dissipation and electric insulation function, which can prevent users from getting an electric shock or being scalded. The lamp housing of the present invention is made of heat conducting plastics, which is easier molded and has lower cost than a conventional heat sink with cooling fins, Furthermore, the lamp housing and the lampshade may be assembled by interlocking, thereby achieving aesthetic and useful effects.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
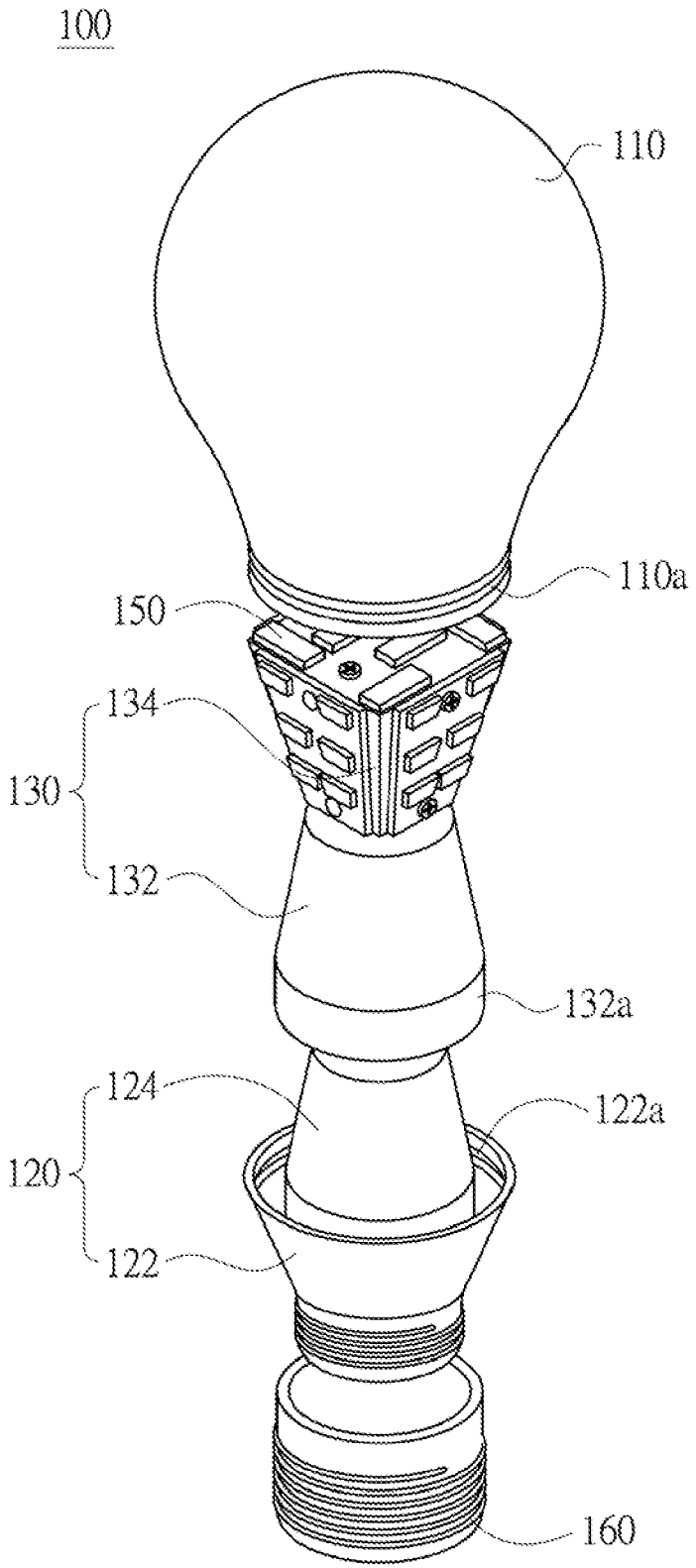
FIG. 1 is a structure-exploded diagram showing a light emitting diode bulb in accordance with an embodiment of the present invention.
Figure 2:
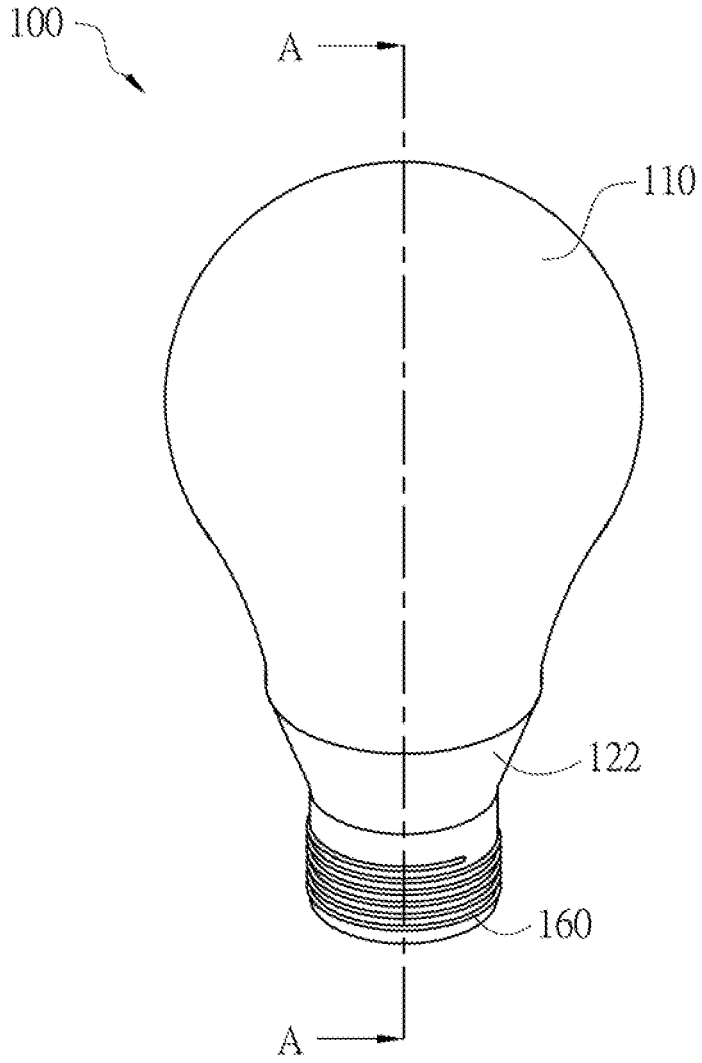
FIG. 2 is a three-dimensional diagram showing a light emitting diode bulb in accordance with an embodiment of the present invention.
Figure 3:
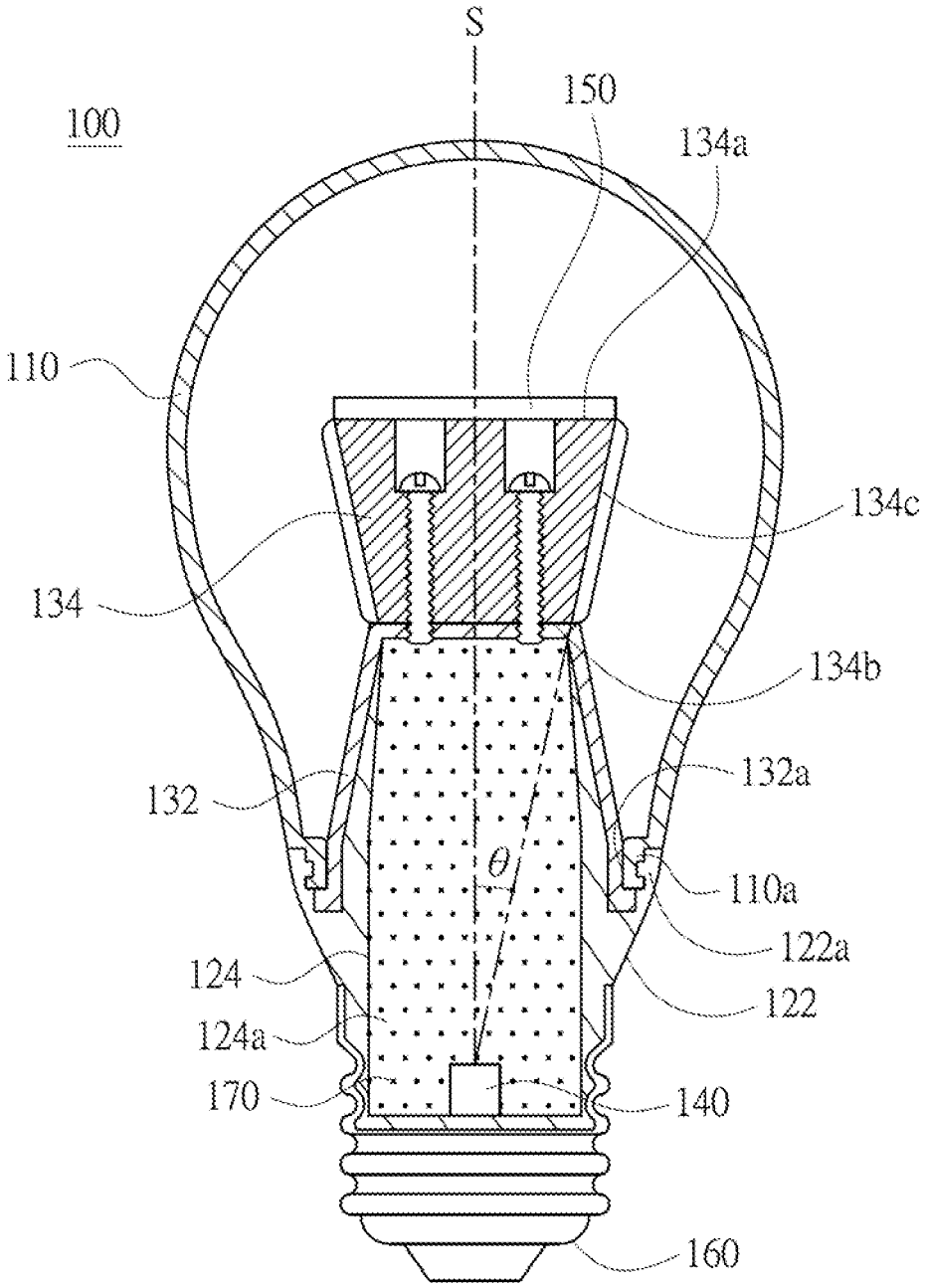
FIG. 3 is a schematic cross-sectional view of the light emitting diode bulb taken along a line A-A in FIG. 2.

Simultaneously refer to FIG. 1 and FIG. 2. FIG. 1 and FIG. 2 are respectively a structure-exploded diagram showing a light emitting diode bulb 100 in accordance with an embodiment of the present invention, and a three-dimensional diagram showing the light emitting diode bulb 100 in accordance with the embodiment of the present invention. In the present embodiment, the light emitting diode bulb 100 includes a lampshade 110, a lamp housing 120, a heat sink 130, a driving circuit 140(as shown in FIG. 3), a plurality of light emitting diode modules 150, and a lamp cap 160. The lampshade 110, the lamp housing 120 and the lamp cap 160 are combined to constitute a shape of a typical bulb.

The light emitting diode modules 150 are adhered to a surface of the heat sink 130. The heat sink 130 and the driving circuit 140 are respectively disposed in the lampshade 110 and the lamp housing 120. The lamp cap 160 is secured on the lamp housing 120 and can be screwed into a light bulb socket to conduct electric power to the driving circuit 140 to light the light emitting diode modules 150. When the light emitting diode modules 150 are illuminating, heat generated by the light emitting diode modules 150 are conducted to the heat sink 130 and dissipated to the external atmosphere through the lamp housing 120.

Referring to FIG. 1 and FIG, 2 again, the lampshade 110 is disposed on the lamp housing 120 and connected with the lamp housing 120. In one embodiment, the lampshade 110 may be made of plastics or other transparent materials. The lamp housing 120 includes a cup-shaped casing 122 and a heat conduction part 124. The heat conduction part 124 is disposed in the cup-shaped casing 122. Referring to FIG. 3 simultaneously, FIG. 3 a schematic cross-sectional view of the light emitting diode bulb taken along a line A-A in FIG. 2. The heat conduction part 124 is a hollow cylinder and has an accommodation space 124*a*. In one embodiment, a top of the cup-shaped casing 122 has an emarginate fringe 122*a*, and a bottom of the lampshade 110 has a flange 110*a*. The flange 110*a* is corresponding to the emarginate fringe 122*a*, so that the lamp housing 120 and the lampshade 110 can be connected by interlocking the emarginate fringe 122*a* and the flange 110*a*. In one embodiment, the lamp housing 120 is made of heat conducting plastics. The driving circuit 140 may be disposed in the accommodation space 124*a* of the heat conduction part 124. The lamp cap 160 is secured to a bottom of the cup-shaped casing 122 and electrically connected to the driving circuit 140. In one embodiment, the light emitting diode bulb 100 of the present invention further includes conductive glue, and the conductive glue can fill the accommodation space 124*a*, so as to increase heat conduction efficiency of the heat conduction part 124.

Referring to FIG, 1 and FIG. 3 again, the heat sink 130 is disposed in the lampshade 110 and connected to the lamp housing 120. The heat sink 130 is mainly used to conduct heat to the lamp housing 120, so as to dissipate heat to the external atmosphere. The heat sink 130 may be made of a metal. The heat sink 130 may include a heat-dissipating shell 132 and a heat-dissipating frustum 134. The heat-dissipating shell 132 covers an outer surface of the heat conduction part 124. In one embodiment, the heat-dissipating shell 132 may be a cone frustum. However, the heat-dissipating shell 132 may be a frustum in another shape, such as a polygonal frustum, corresponding to a shape of the heat conduction part 124. In addition, the heat-dissipating shell 132 may be connected with the heat conduction part 124 by screwing or by using thermally conductive glue, so that the heat of the heat-dissipating shell 132 can be conducted to the heat conduction part 124. As shown in FIG. 3, in one embodiment, a bottom of the heat-dissipating shell 132 may have an annular recess 132*a*, Because the heat-dissipating shell 132 is a shell, when the lamp housing 120 and the lampshade 110 are interlocked together, the heat-dissipating shell 132 is squeezed by the flange 110*a* of the lampshade 110. Therefore, the annular recess 132*a* is against the flange 110*a* to achieve a securing effect.

The heat-dissipating frustum 134 is connected to the heat-dissipating shell 132. In one embodiment, the heat-dissipating shell 132 and the heat-dissipating frustum 134 are embedded with each other to form a one-body structure. In other embodiments, the heat-dissipating frustum 134 is fixed on the heat-dissipating shell 132 by a screwing means or a soldering means. The heat-dissipating frustum 134 includes a top surface 134*a*, a bottom surface 134*b* and four side surfaces 134*c*. The top surface 134*a* and the bottom surface 134*b* are rectangular, and an area of the top surface 134*a* is greater than an area of the bottom surface 134*b*, so that the side surfaces 134*c* are inverse trapezoids. In addition, as shown in FIG. 3, the heat-dissipating frustum 134 has an axis S vertical to the bottom surface 134*b*. An included angle θ the axis S and each of the side surfaces 134*c* is smaller than 90 degrees. Therefore, each of the side surfaces 134*c* is inclined to the axis S. The light emitting diode modules 150 are respectively adhered to the top surface 134*a* and the side surfaces 134*c* of the heat-dissipating frustum 134, and the light emitting diode modules 150 are electrically connected to the driving circuit 140. When the light emitting diode modules 150 on the top surface 134*a* and the side surfaces 134*c* illuminate simultaneously, the light emitting diode modules 150 can achieve an omni-directional lighting effect, In one embodiment, the included angle θ between the axis S and each of the side surfaces 134*c* may be from 0 to 45 degrees.

In another embodiment, each of the light emitting diode modules 150 may be a common-anode diode module or a common-cathode diode module. When the light emitting diode modules 150 are disposed on the heat-dissipating frustum 134, the anodes or the cathodes of the light emitting diode modules 150 are connected to each other through the heat-dissipating frustum 134.

To sum up, a heat dissipation process of the light emitting diode bulb 100 of the present invention is described as following. Heat generated by the light emitting diode modules 150 is firstly conducted from the heat-dissipating frustum 134 to the heat-dissipating shell 132. Because the heat--dissipating shell 132 contacts with the heat conduction part 124, and the heat conduction part 124 is made of heat conducting plastics, the heat conducted to the heat-dissipating shell 132 are further conducted to the heat conduction part 124. Moreover, because the heat conduction part 124 has a heat-conducting function, the heat conducted to the heat conduction part 124 are further conducted to the cup-shaped casing 122 and dissipated to the external atmosphere to achieve a heat-dissipating effect.

According to the aforementioned embodiments of the present invention, it is known that the light emitting diode modules are disposed on the trapezoid heat-dissipating frustum. Therefore, when the light emitting diode modules illuminate, the light emitting diode modules emit light from the top surface and the side surfaces of the heat-dissipating frustum, thereby achieving an effect of omni-directional lighting.

According to the aforementioned embodiments of the present invention, it is known that the lamp housing is made of heat conducting plastics and the heat sink is made of metal. Therefore, heat generated by the light emitting diode modules can be directly conducted from the heat sink to the lamp housing and further dissipated to the external atmosphere by connecting the heat sink and the lamp housing to achieve a superior heat-dissipating effect. Moreover, the lamp housing has functions of heat dissipation and electric insulation, thereby can prevent users from getting an electric shock or being scalded.

According to the aforementioned embodiments of the present invention it is known that the lamp housing is made of heat conducting plastics, which is easier molded and has lower: cost than a conventional heat sink with cooling fins. Moreover, the lamp housing and the lampshade are assembled by interlocking to form a bulb of an integrated structure, thereby achieving aesthetic and useful effects.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A light emitting diode bulb, comprising:

a lampshade;

a lamp housing connected to the lampshade, wherein the lamp housing comprises:

a cup-shaped casing; and a heat conduction part disposed in the cup-shaped casing, wherein the heat conduction part is a hollow cylinder and has an accommodation space;

a heat sink disposed in the lampshade, wherein the heat sank comprises:

a heat-dissipating shell covering an outer surface of the heat conduction part; and a heat-dissipating frustum connected to the heat-dissipating shell and comprising a top surface, a bottom surface and four side surfaces, wherein the top surface and the bottom surface are rectangular, an area of the top surface is greater than an area of the bottom surface, and the side surfaces are inverse trapezoids, wherein the heat-dissipating frustum comprises an axis vertical to the bottom surface, and an included angle between the axis and each of the side surfaces is smaller than 90 degrees;

a driving circuit disposed in the accommodation space;

a plurality of light emitting diode modules adhered to the top surface and the side surfaces of the heat-dissipating frustum, wherein the light emitting diode modules are electrically connected to the driving circuit; and a lamp cap secured to a bottom of the cup-shaped casing and electrically connected to the driving circuit.

2. The light emitting diode bulb of claim 1, wherein the included angle between the axis and each of the side surfaces is from 0 to 45 degrees.

3. The light emitting diode bulb of claim 1, further comprising conductive glue filling the accommodation space.

4. The light emitting diode bulb of claim 1, wherein each of the light emitting diode modules is a common-anode diode module or common-cathode diode module.

5. The light emitting diode bulb of claim 1, wherein the heat-dissipating frustum is fixed on the heat-dissipating shell by a screwing means or a soldering means.

6. The light emitting diode bulb of claim 1, wherein the heat-dissipating shell and the heat-dissipating frustum are embedded with each ether to form a one-body structure.

7. The light emitting diode bulb of claim 1, wherein the heat sink is made of a metal.

8. The light emitting diode bulb of claim 1, wherein the lamp housing is made of heat conducting plastics.

9. The light emitting diode bulb of claim 1, wherein a bottom of the lampshade has a flange, and the cup-shaped casing has an emarginate fringe corresponding to the flange, wherein the flange and the emarginate fringe are interlocked together.

10. The light emitting diode bulb of claim 9, wherein a bottom of the heat-dissipating shell has an annular recess, and when the flange and the emarginate fringe are interlocked together, the annular recess is against and secures the flange.

* * * * *